US006563368B2

(12) United States Patent
Ferianz

(10) Patent No.: US 6,563,368 B2
(45) Date of Patent: May 13, 2003

(54) INTEGRABLE CURRENT SUPPLY CIRCUIT WITH PARASITIC COMPENSATION

(75) Inventor: Thomas Ferianz, Glanegg (AT)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/972,836

(22) Filed: Oct. 5, 2001

(65) Prior Publication Data

US 2002/0109541 A1 Aug. 15, 2002

(30) Foreign Application Priority Data

Oct. 13, 2000 (DE) ..... 100 50 708

(51) Int. Cl.[7] ..... G05F 1/10

(52) U.S. Cl. ..... 327/538; 327/540; 327/545; 323/315

(58) Field of Search ..... 327/538, 542, 327/543, 545; 323/312, 315

(56) References Cited

U.S. PATENT DOCUMENTS 4,366,445 A * 12/1982 Cave et al. ..... 323/315
4,644,194 A * 2/1987 Birrittella et al. ..... 323/315
5,485,074 A * 1/1996 Tomasini et al. ..... 323/312
5,512,817 A * 4/1996 Nagaraj ..... 323/316
5,535,243 A 7/1996 Voegele et al.
5,661,383 A * 8/1997 Schlager et al. ..... 323/315
5,818,295 A * 10/1998 Chimura et al. ..... 323/315
5,963,082 A * 10/1999 Dick et al. ..... 323/312
6,144,250 A * 11/2000 Owen et al. ..... 327/540

FOREIGN PATENT DOCUMENTS

DE 195 10 279 A1 9/1995
EP 0 836 286 A1 4/1998

* cited by examiner

*Primary Examiner*—Terry D. Cunningham
(74) *Attorney, Agent, or Firm*—Welsh & Katz, Ltd.

(57) ABSTRACT

Integrable current supply circuit An integrable current supply circuit for feeding a supply current to a signal line (12) having a current source (14) for producing a source current which is emitted via a connection line (18) to an input of a current amplifier (20), which amplifies the source current and feeds the amplified source current as a supply current via a current output (2) of the current supply line to the signal line (12), with the current source (14) and the current amplifier (20) having parasitic capacitances, distinguished by a compensation capacitor (28) which is connected to the current output (2) and whose capacitance corresponds to the parasitic capacitances, and a current mirror circuit (31) which emits the charging current that flows through the compensation capacitor (28) in order to compensate for the charging currents flowing through the parasitic capacitances in mirrored form onto the connection line (18) connected between the current source (14) and the current amplifier (20).

13 Claims, 6 Drawing Sheets

SIdT

SIdT

INTEGRABLE CURRENT SUPPLY CIRCUIT WITH PARASITIC COMPENSATION

BACKGROUND OF THE INVENTION

The invention relates to an integrable current supply circuit for feeding a supply current to a signal line.

Terminals which are connected to a signal line are in many applications supplied via the signal line with a supply current as the power supply for the terminal. This supply current is in this case produced by a current supply circuit, which is connected to the signal line.

EP 0 836 286 A1 describes a circuit arrangement for obtaining a supply voltage from a bus line on which message signals are superimposed on an operating voltage. The circuit arrangement contains a constant current source and what is referred to as a diplexer, which is actuated when message pulses occur. A circuit section is provided which provides the diplexer element with a control current without influencing the constant current source.

DE 195 10 279 A1 describes a current source power supply with a current mirror circuit having a high input impedance, and with a current which flows in a first and a second current path.- Furthermore, the current source power supply contains a current reference device and a current sensing device, as well as a feedback circuit.

U.S. Pat. No. 5,535,243 describes a transmitter power supply circuit, which receives a loop current from a control loop, and supplies a measurement circuit with current.

FIG. 1 shows a signal line to which a terminal which has the impedance $Z_L$ is connected. Signals, that is to say voice or data signals, are transmitted via the line and are emitted by a signal driver circuit. The signal driver circuit receives the signals to be transmitted from a current source. The supply current for the terminal is fed in at a node K. The supply current is produced by a conventional current source. In this case, the current source contains a voltage source, whose output is connected to an inductance L. The impedance of the inductance L is in this case designed such that, even at high frequencies, the output impedance of the current source is greater than a predetermined minimum impedance which is specified, for example, in CCITT Standard I.430 as an impedance template to be complied with.

The disadvantage of the current source according to the prior art illustrated in FIG. 1, for feeding a supply current into the signal line, is that the inductance or inductor L cannot be integrated and must be connected to an integrated circuit as an external component.

The current supply circuit illustrated in FIG. 2 has thus been proposed in the prior art.

The conventional supply circuit shown in FIG. 3 comprises a current source IQ, whose source current is amplified by a transistor T and is emitted as the supply current $I_{supply}$ via the output A of the current supply circuit to the feed node K. The operating point of the transistor T is in this case set by means of a current source $I_0$.

The disadvantage of the conventional current supply circuit illustrated in FIG. 2 is that the transistor T, which acts as a current amplifier, and the current source IQ have parasitic capacitances, which are indicated by dashed lines as the parasitic capacitor $C_{par}$ in FIG. 2. The parasitic capacitances that are contained in the current supply circuit severely reduce the output impedance $Z_{out}$ of the current supply circuit at high frequencies, so that the minimum current source impedances specified by the Standard are not complied with.

FIG. 3 shows the profile of the output impedance of the conventional current supply circuit illustrated in FIG. 2. As can be seen from FIG. 3, the impedance template to be complied with in accordance with CCITT I1.430 is considerably undershot above a frequency of about 60 kHz.

SUMMARY OF THE INVENTION

The object of the present invention is therefore to provide an integrable current supply circuit which has a high output impedance $Z_{out}$ even at high frequencies.

According to the invention, this object is achieved by an integrable current supply circuit having the features specified in patent claim 1.

The invention provides an integrable current supply circuit for feeding a supply current to a signal line having a current source for producing a source current which is emitted via a connection line to an input of a current amplifier, which amplifies the source current and feeds the amplified source current as a supply current via an output of the current supply line to the signal line, with the current source and the current amplifier each having parasitic capacitances, with the integrable current supply circuit according to the invention furthermore having a compensation capacitor which is connected to the output of the current supply circuit and whose capacitance corresponds to the parasitic capacitance, and a current mirror circuit which emits the charging current that flows through the compensation capacitor in order to compensate for the charging currents flowing through the parasitic capacitances in mirrored form onto the connection line connected between the current source and the current amplifier.

The magnitude of the source current is preferably adjustable.

The current source is preferably a pnp bipolar transistor or a PMOS transistor.

The operating point of the current amplifier is preferably adjustable.

In one preferred embodiment of the integrable current supply circuit, the current mirror circuit comprises two npn bipolar transistors, whose base connections are connected to one another.

In an alternative embodiment, the current mirror circuit comprises two NMOS transistors, whose gate connections are connected to one another.

The current mirror circuit of the integrable current supply circuit according to the invention preferably mirrors the current flowing through the parasitic capacitances with a predetermined current mirror ratio, and emits the mirrored current in inverted form to the connection line.

In one preferred embodiment, the current mirror ratio of the current mirror circuit is minus one.

In an alternative embodiment, the current/mirror ratio is equal to the ratio of the parasitic capacitances to the capacitance of the compensation capacitor.

The quiescent current of the current mirror circuit is preferably adjustable.

In one particularly preferred embodiment of the integrable current supply circuit, this circuit is designed differentially.

The output impedance of the current supply circuit according to the invention is preferably high over a broad frequency range from 1 kHz to 1 MHz, and is greater than a predetermined minimum impedance value.

Preferred embodiments of the integrable current supply circuit according to the invention will be described in the following text with reference to the attached figures in order to explain features that are essential to the invention.

DETAILED DESCRIPTION OF THE INVENTION

Figure 1:
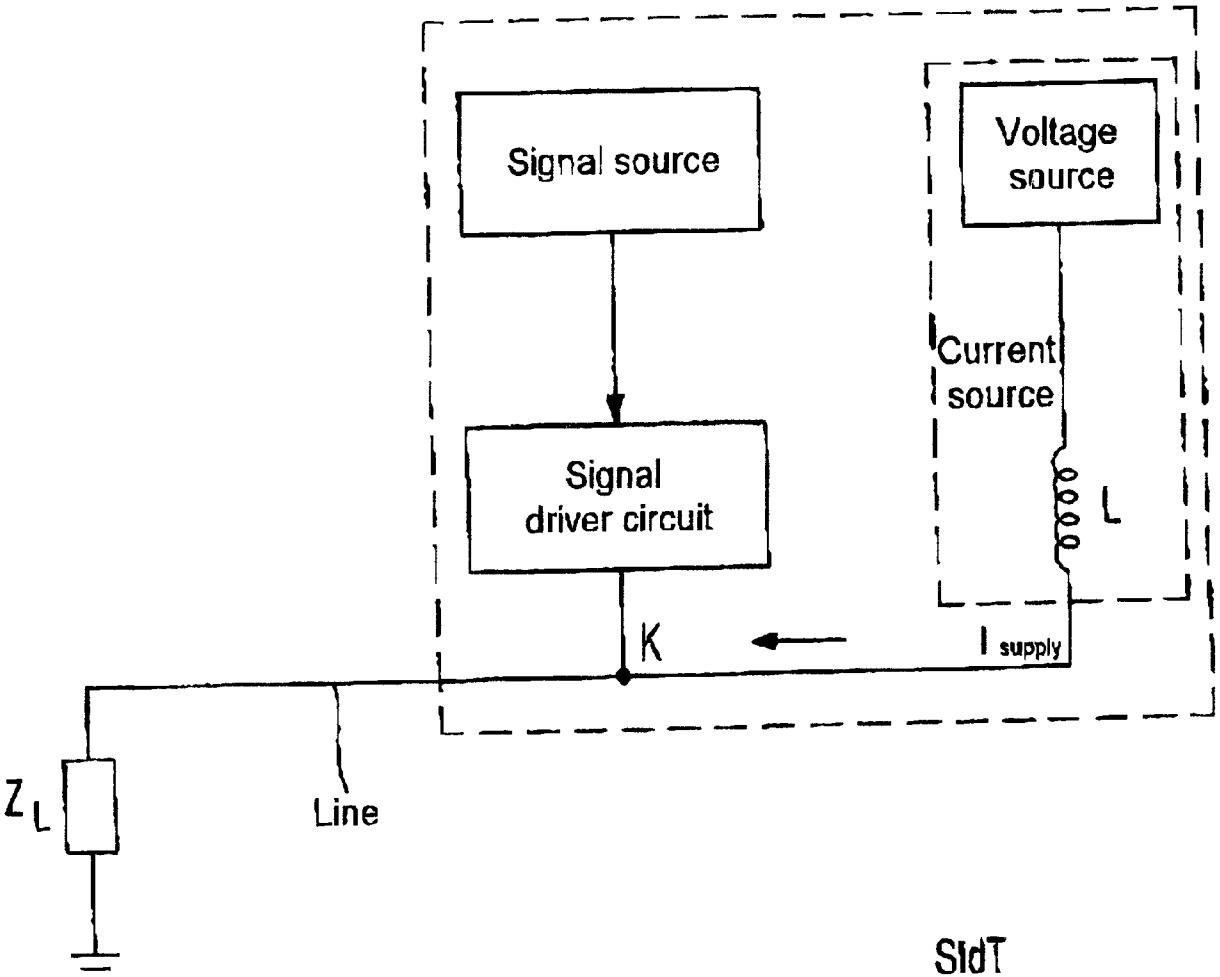
FIG. 1 shows a current supply circuit according to the prior art.
Figure 2:
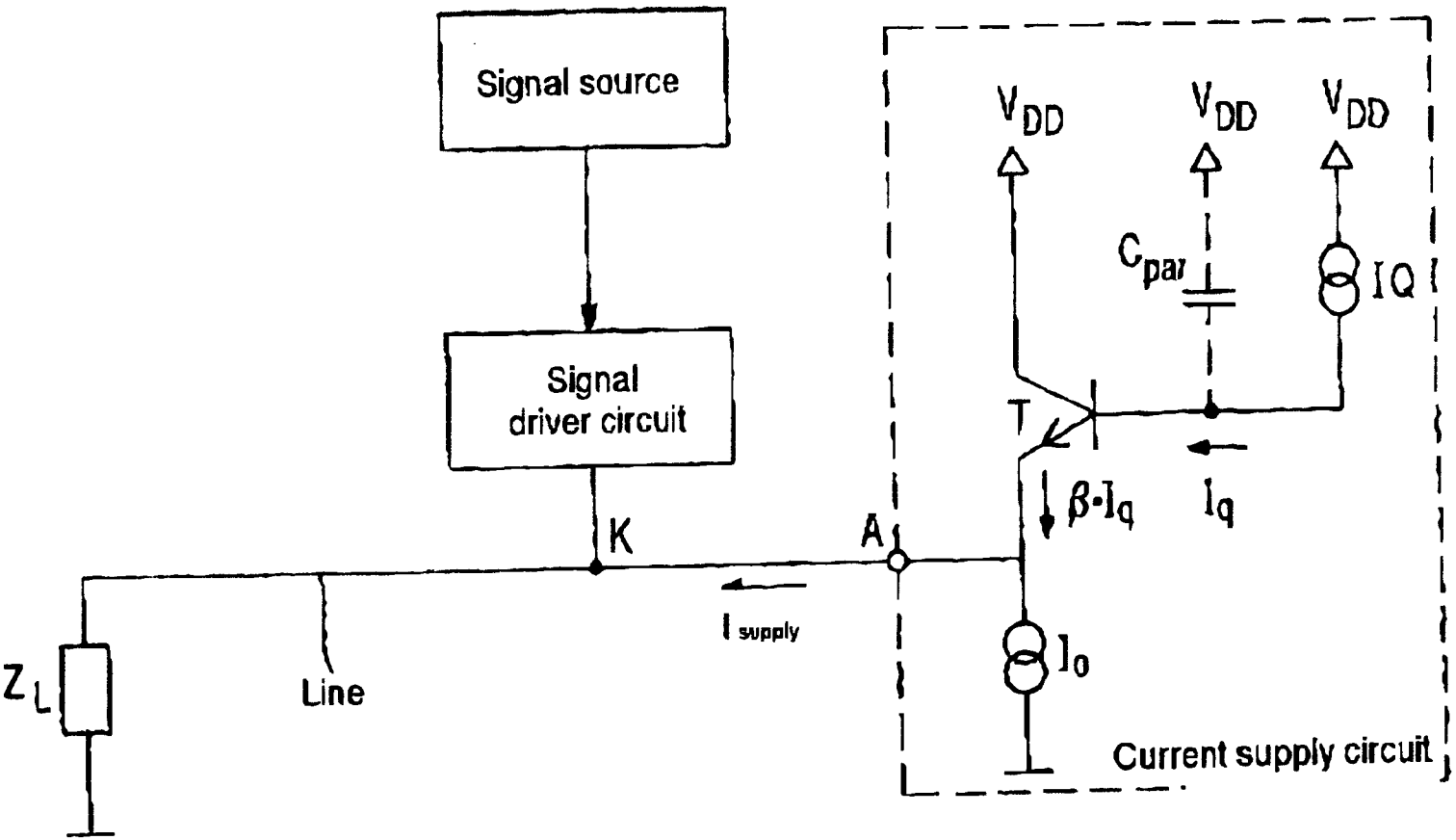
FIG. 2 shows an integrable current supply circuit according to the prior art.
Figure 3:
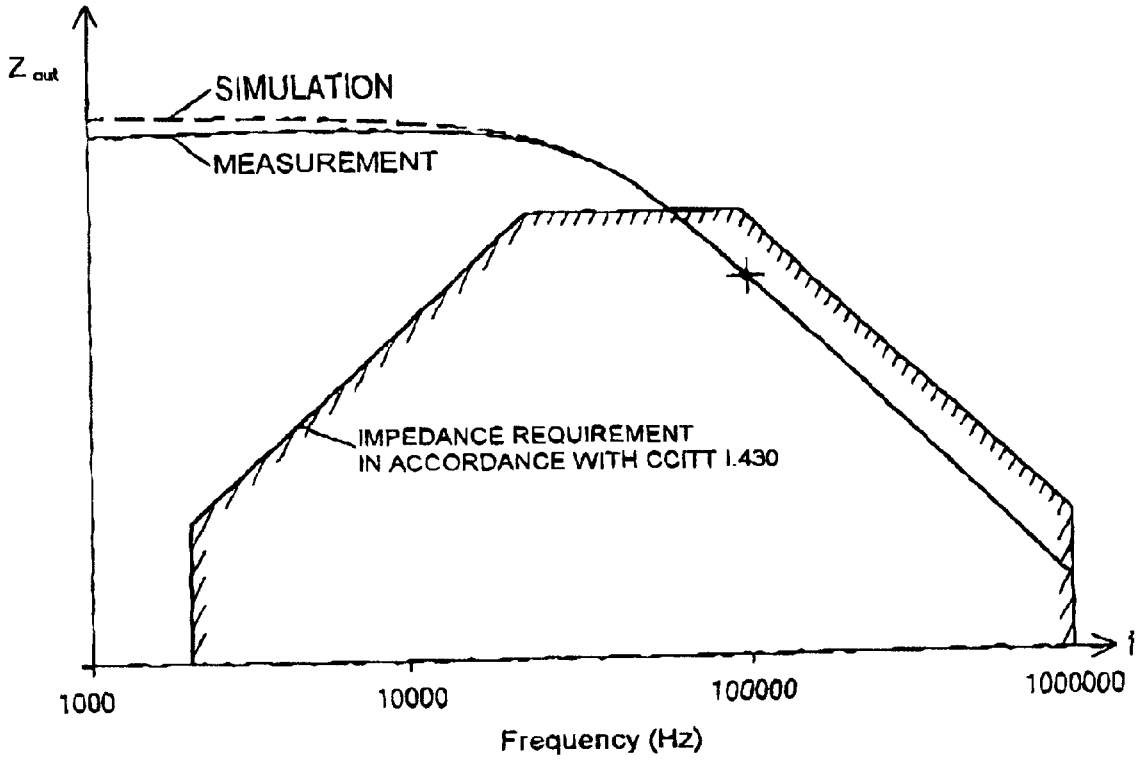
FIG. 3 shows the frequency response of the output impedance of the integrable current supply circuit according to the prior art illustrated in FIG. 2.
Figure 4:
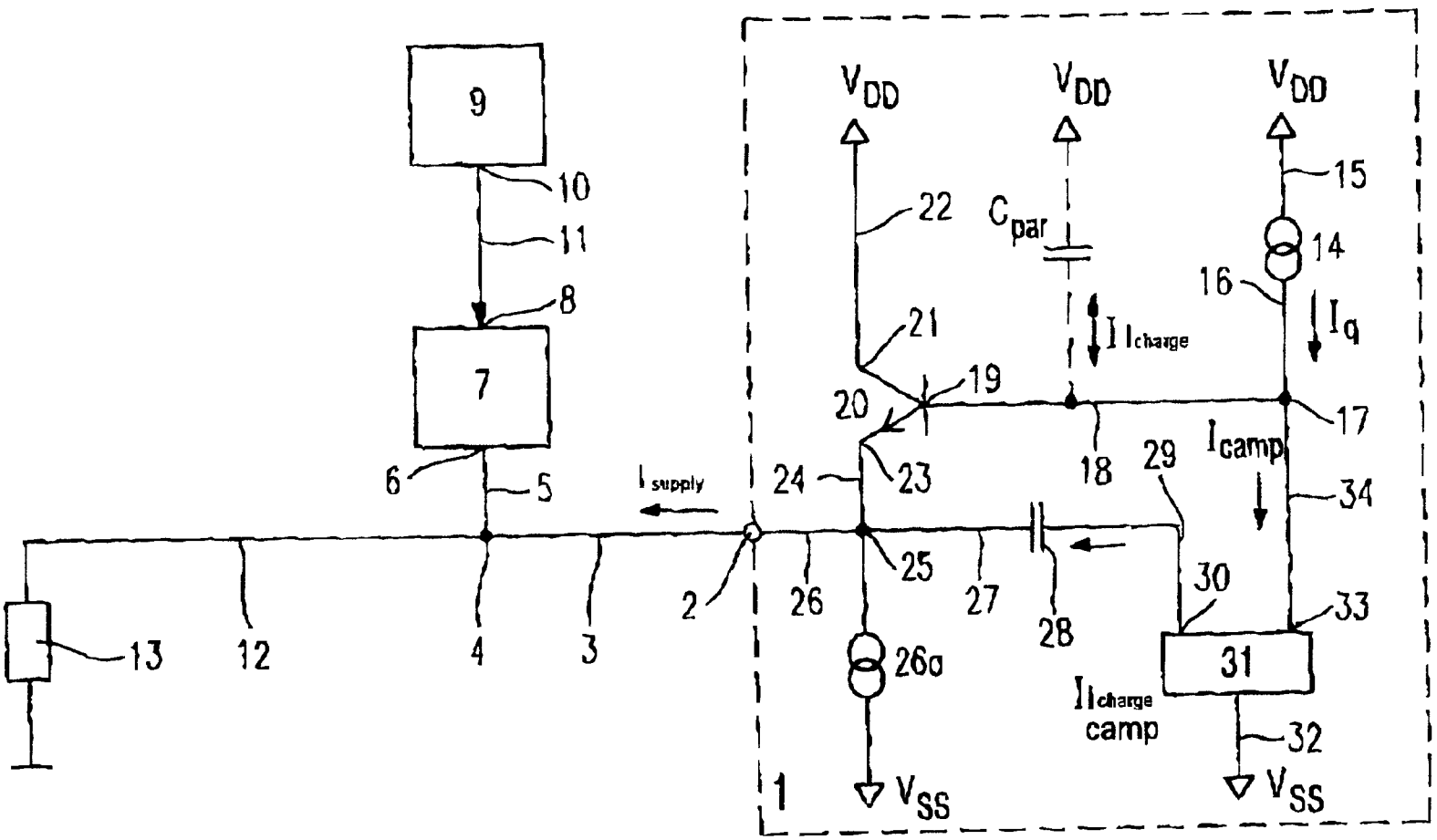
FIG. 4 shows an integrable current supply circuit according to the invention.

As can be seen from FIG. 4, the integrable current supply circuit 1 according to the invention has an output 2 for emitting a supply current via a connecting line 3 to a feed node 4. An output 6 of a signal driver circuit 7 is connected to the feed node 4 via a line 5. The signal driver circuit 7 has a signal input 8. A signal source 9 generates a signal to be transmitted, and emits the signal via a signal output 10 and a line 11 to a signal input 8 of the signal driver circuit 7. The feed node 4 is connected via a signal line 12 to a load 13, which represents the terminal to be supplied. The terminal is, for example, a telephone terminal, which is supplied with the supply current produced by the current supply circuit 1. The signal line 12 is preferably a two-wire telephone line. The voice or data signal emitted from the signal drive circuit, together with the supply current that is fed in, are thus transmitted via the two-wire telephone line 12.

The integrable current supply circuit 1 contains a current source 14 for producing a source current $I_Q$. The current source 14 is preferably formed by a pnp bipolar transistor. The current source 14 is connected via a line 15 to the positive supply voltage $V_{DD}$. The current source 14 is also connected via a line 16 to a node 17. The node 17 is connected via a line 18 to a base connection 19 of an npn transistor 20. The npn transistor 20 has a collector connection 21, which is connected via a line 22 to the positive supply voltage $V_{DD}$. The transistor 20 also has an emitter connection 23, which is connected via a line 24 to a node 25. The node 25 is connected via a line 26 to the current output 2 of the current supply circuit 1. The node 25 is also connected via a current source 26*a* to the negative supply voltage $V_{ss}$. The current source 26*a* is used to adjust the operating point of the transistor 20. The node 25 is connected via a line 27 to a compensation capacitor 28, which is connected via a line 29 to an input 30 of a current mirror circuit 31. The current mirror circuit 31 is connected via a line 32 to the negative supply voltage $V_{ss}$. The current mirror circuit 31 has an output 33, which is connected via a line 34 to the node 17.

The current source 14 and the transistor 20, which acts as a current amplifier, have parasitic capacitances, which are represented by dashed lines as a parasitic capacitor $C_{par}$ in FIG. 4.

In this case:

$$C_{par}=C_{par_{14}}+C_{par_{20}} \tag{1}$$

where $C_{par_{14}}$ is the parasitic capacitance of the current source 14, and $C_{par_{20}}$ is the parasitic capacitance of the npn transistor 20.

The capacitance of the compensation capacitor 28 essentially corresponds to the parasitic capacitance. Ideally, the capacitance of the compensation capacitor 28 is precisely the same as the parasitic capacitance of the current supply circuit.

$$C_{comp}=C_{par} \tag{2}$$

where $C_{comp}$ is the capacitance of the compensation capacitor 28.

The npn transistor 20 amplifies the source current emitted from the pnp transistor 14 with a specific current gain factor β, and emits the amplified current as the supply current via the current output 2 to the signal line 12. The current gain produced by the npn transistor 20 is required since no pnp transistor 14 is available, due to the technology, to supply the required supply current of 10 to 200 mA for a predetermined chip surface area. The parasitic capacitances $C_{par}$ produce unwanted charging currents, which increase as the frequency rises. In order to compensate for the charging currents $I_{charge}$ flowing through the parasitic capacitances, the current mirror circuit 31 mirrors the charging current flowing through the compensation capacitor 28, and emits the mirrored charging current as the compensation current $I_{comp}$ to the node 17. In the process, the current mirror circuit 31 inverts the charging current of the compensation capacitor 28 flowing into the input 30. The compensation current $I_{comp}$ compensates for the charging current into the parasitic capacitances.

In this case:

$$I_{comp}=K\cdot I_{charge_{28}} \tag{3}$$

where $I_{comp}$ is the compensation current emitted at the output 33, $I_{charge_{28}}$ is the charging current flowing through the compensation capacitor 28, and K is the current mirror ratio of the current mirror circuit 31.

The current mirror ratio of the current mirror circuit 31 is preferably:

$$K=-1 \tag{4}$$

Since the capacitance of the compensation capacitor 28 corresponds essentially to the capacitance of the parasitic capacitance $C_{par}$, then:

$$C_{comp}=I_{charge\text{-}par} \tag{5}$$

where $I_{charge\text{-}par}$ is the charging current of the parasitic capacitances.

In the embodiment illustrated in FIG. 4, the current amplification transistor 20 is an npn bipolar transistor. The current source 14 is preferably likewise a bipolar transistor, namely a pnp bipolar transistor. The bipolar transistor which forms the current source 14 and the bipolar transistor which forms the current amplifier 20 are complementary to one another.

In an alternative embodiment, the integrable current supply circuit 1 according to the invention is partially formed from MOSFET transistors, with the current source 14 being formed by a PMOS transistor.

Figure 5:
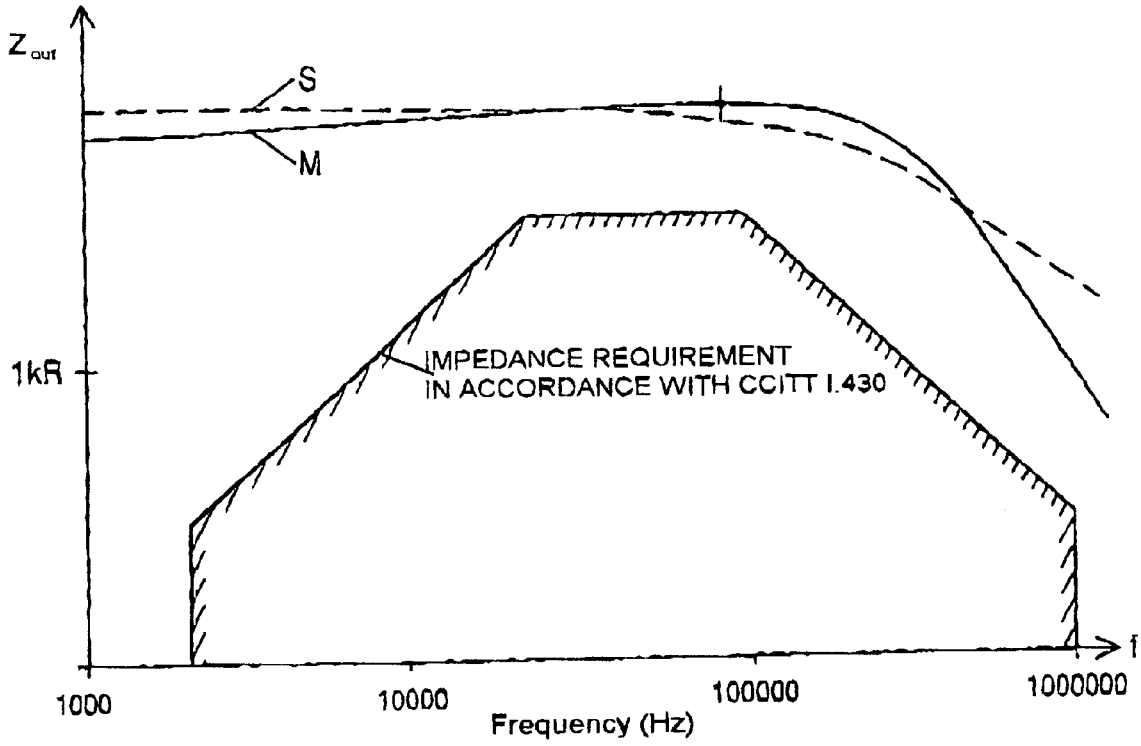
FIG. 5 shows the frequency response on the output impedance of the integrable current supply circuit according to the invention.

FIG. 5 shows the frequency response of the output impedance $Z_{out}$ at the current output 2 of the integrable current supply circuit 1 according to the invention. This shows a simulation result S and a measurement result M. As can be seen from FIG. 5, the output impedance $Z_{out}$ of the integrable current supply circuit 1 according to the invention remains above the minimum impedance required by CCITT I.430 over the entire frequency range.

Figure 6:
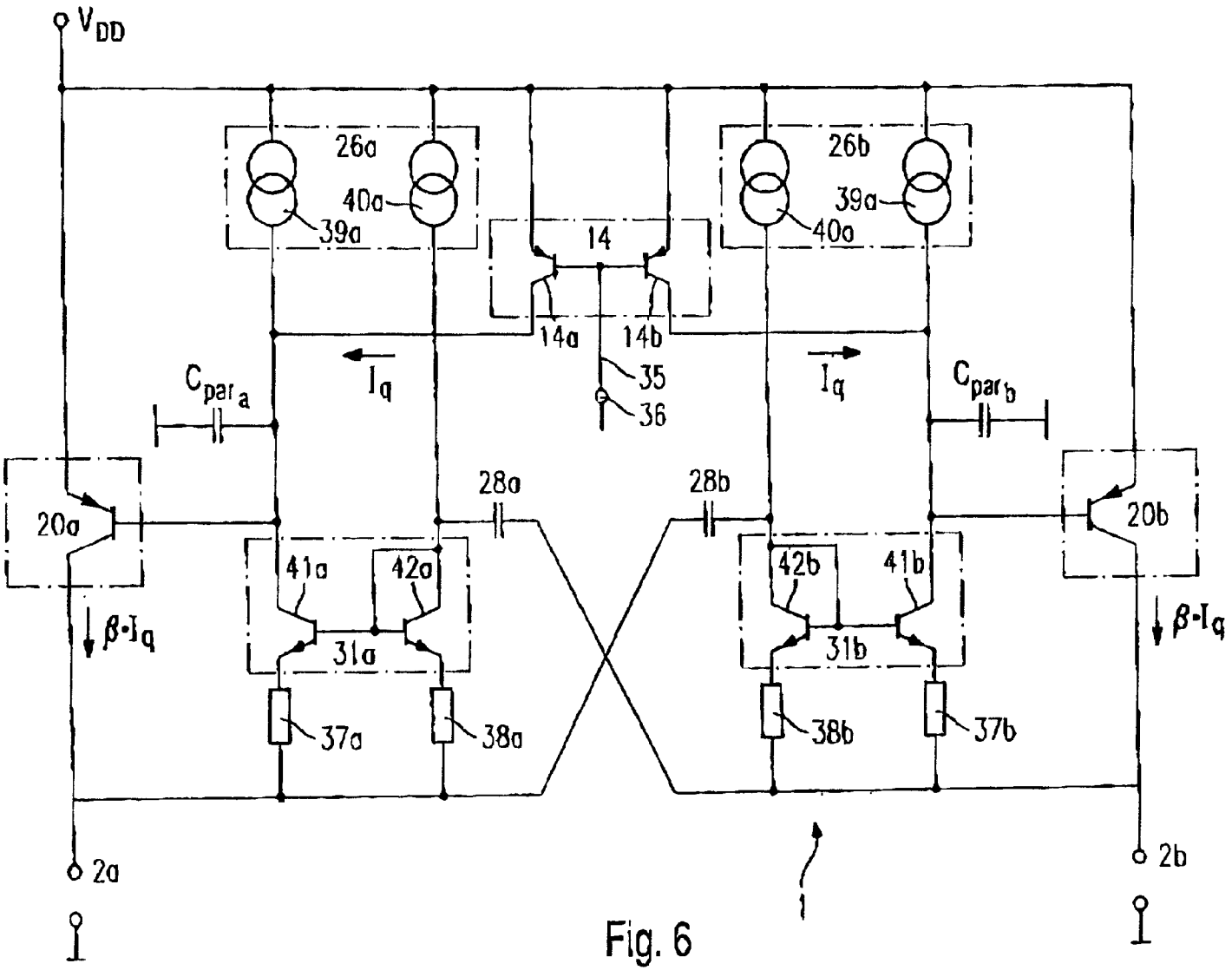
FIG. 6 shows a differentially designed embodiment of the integrable current supply circuit according to the invention.

FIG. 6 shows one preferred embodiment of the integrable current supply circuit according to the invention. The embodiment illustrated in FIG. 6 shows a fully differentially designed integrable current supply circuit 1 according to the invention. The differentially designed current supply circuit 1 is designed to be balanced. The current supply circuit 1 contains two current sources 14*a,* 14*b,* which are pnp transistors. The base connections for the pnp transistors 14*a,* 14*b* are connected to one another, and are connected via a line 35 to an adjustment connection 36 for adjusting the source current. The two pnp transistors 14*a,* 14*b* supply for example, a source current of about 2 mA.

The current supply circuit also contains two npn transistors 20*a,* 20*b* for current amplification of the source current emitted from the current source 14. The current gain factor β is in this case preferably about 100. The current supply circuit 1 thus supplies the required output current of 200 mA at the two current outputs 2*a,* 2*b.*

As is illustrated in FIG. 6, the current supply circuit 1 also contains current mirror circuits 31*a,*31*b,* which each contain two npn transistors. The quiescent point and the operating point of the current mirror circuits 31*a,* 31*b* are each set by means of a quiescent-current adjustment circuit 26*a,* 26*b.* The operating point adjustment circuits 26*a,* 26*b* each contain two adjustable current sources. The resistors 37, 38, which are connected to the emitter connections of the transistors contained in the current mirror circuits 31*a,* 31*b,* increase the accuracy of the current mirror ratio K of the current mirror circuits 31*a,* 31*b.*

The quiescent-current adjustment circuits 26 contain a first current source 39 and a second current source 40. The current mirror circuits 31 each contain two transistors 41, 42.

The parasitic capacitance $C_{par}$ illustrated in FIG. 6 comprises the base/collector capacitance of the current amplification transistor 20, the parasitic base/collector capacitance of the current source 14, the parasitic capacitance of the current source 39 and the parasitic base/collector capacitance of the transistor 41 within the current mirror circuit.

The current supply circuit also contains compensation capacitors 28*a,* 28*b,* whose capacitance corresponds approximately to the existing parasitic capacitance $C_{par}$. In the embodiment illustrated in FIG. 6, the charging current flowing through the parasitic capacitances need only be mirrored by the current mirror circuits 31, since the inversion is achieved by the connection of a compensation capacitor 28 to the antiphase current output. The compensation capacitor 28*a* is, as can be seen in FIG. 6, connected to the antiphase current output 2*b,* while the compensation capacitor 28*b* is connected to the current output 2*a.*

The capacitance of the compensation capacitor 28 is given by:

$$C_{comp} = \frac{C_{par}}{K} \tag{6}$$

where

K is the current mirror ratio of the current mirror circuits 31, and $C_{par}$ is the parasitic capacitance.

The current mirror ratio K is preferably 1 in the embodiment illustrated in FIG. 6.

What is claimed is:

1. An integrable current supply circuit for feeding a supply current to a signal line having:

a current source for producing a source current which is emitted via a connection line to an input of a current amplifier, which amplifies the source current and feeds the amplified source current as a supply current via a current output of the current supply line to the signal line, with the current source and the current amplifier having parasitic capacitances;

a compensation capacitor which is connected to the current output and whose capacitance corresponds to the parasitic capacitances; and a current mirror circuit which emits the charging current that flows through the compensation capacitor in order to compensate for the charging currents flowing through the parasitic capacitances in mirrored form onto the connection line connected between the current source and the current amplifier.

2. The current supply circuit as claimed in claim 1, wherein the magnitude of the source current is adjustable.

3. The current supply circuit as claimed in claim 1, wherein the current source is a pnp bipolar transistor or a PMOS transistor.

4. The current supply circuit as claimed in claim 1, wherein the current amplifier is an npn bipolar transistor.

5. The current supply circuit as claimed in claim 1, wherein the operating point of the current amplifier (20) can be adjusted by means of a current source (26).

6. The current supply circuit as claimed in claim 1, wherein the current mirror circuit comprises two npn bipolar transistors, whose base connections are connected to one another.

7. The current supply circuit a claimed in claim 1, wherein the current mirror circuit comprises two NMOS transistors, whose gate connections are connected to one another.

8. The current supply circuit as claimed in claim 1, wherein the current mirror circuit emits the charging current flowing through the parasitic capacitances, mirrored with a predetermined current mirror ratio and inverted, to the connection line.

9. The current supply circuit as claimed in claim 1, wherein the current mirror ratio is −1.

10. The current supply circuit as claimed in claim 1, wherein the current mirror ratio is equal to the ratio of the parasitic capacitances to the capacitance of the compensation capacitor.

11. The current supply circuit as claimed in claim 1, wherein the quiescent current of the current mirror circuit is adjustable.

12. The current supply circuit as claimed in claim 1, wherein the current supply circuit is designed differentially.

13. The current supply circuit as claimed in claim 1, wherein the output impedance of the current supply circuit is high, and is greater than a predetermined minimum impedance over a broad frequency range from 1 kHz to 1 MHz.

* * * * *